US007114302B2

(12) United States Patent
Tanase et al.

(10) Patent No.: US 7,114,302 B2
(45) Date of Patent: Oct. 3, 2006

(54) FLOOR STRUCTURE AND FLOOR BASE PANEL

(75) Inventors: Rento Tanase, Shizuoka-ken (JP); Yoshikazu Honji, Hamamatsu (JP); Tetsu Kobayashi, Hamakita (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/375,624

(22) Filed: Feb. 27, 2003

(65) Prior Publication Data

US 2003/0167710 A1 Sep. 11, 2003

(30) Foreign Application Priority Data

Mar. 6, 2002 (JP) ..... P2002-060184

(51) Int. Cl.
*E04C 2/52* (2006.01)

(52) U.S. Cl. ..... 52/220.1; 52/126.6; 52/403.1

(58) Field of Classification Search ..... 52/220.1, 52/787.11, 220.3, 126.6, 403.1, 480
See application file for complete search history.

(56) References Cited

U.S. PATENT DOCUMENTS

| | | | | |
|---|---|---|---|---|
| 5,042,569 | A * | 8/1991 | Siegmund | 165/56 |
| 5,396,747 | A | 3/1995 | Breuning | 52/516 |
| 5,501,754 | A * | 3/1996 | Hiraguri | 156/71 |
| 6,463,704 | B1 * | 10/2002 | Jette | 52/125.2 |
| 6,536,168 | B1 * | 3/2003 | Cugini et al. | 52/220.2 |

FOREIGN PATENT DOCUMENTS

| | | |
|---|---|---|
| DE | 1935580 | 1/1971 |
| EP | 0652 336 A | 5/1995 |
| JP | SHO-60-4112 | 1/1985 |
| JP | SHO-62-146832 | 9/1987 |
| JP | SHO-63-58129 | 4/1988 |
| JP | P2000-87538 A | 3/2000 |
| JP | 2001-263410 | 9/2001 |
| WO | WO9201130 A | 1/1992 |

OTHER PUBLICATIONS

Hidehiro Sumita, Japanese Office Action, Notice of Reason for Rejection, Japanese Patent Office (Japan), pp. all, (Feb. 27, 2006).

* cited by examiner

*Primary Examiner*—Ramon O Ramirez
(74) *Attorney, Agent, or Firm*—Pillsbury Winthrop Shaw Pittman LLP

(57) ABSTRACT

In the floor base panel (40), an area on the support board (33) of the vibration proof support leg (30) is formed solid, and in the other area, a plurality of cavities (41) extending parallel to the floor surface are formed. Thereby, because the vibration energy propagated from the impact point of the floor base panel (40) is reflected on the boundary between the cavity formation area and the solid area, and repeatedly passes the cavity formation area, it is attenuated in a short time, and the vibration energy or sound energy transmitted to a slab (20) can be reduced.

29 Claims, 15 Drawing Sheets

FLOOR STRUCTURE AND FLOOR BASE PANEL

BACKGROUND OF THE INVENTION

The present invention relates to a floor structure arranged on a slab of a building such as a multiple dwelling house, and a floor base panel used for the floor structure.

As the floor structure of the building of the multiple dwelling houses such as an apartment house, generally, a dry type sound shielding double floor is used. Conventional dry type sound shielding double floor is structured in such a manner that a vibration-proof support leg is arranged on the slab which is a concrete floor, at a predetermined interval, each edge of the floor base panel constituted by a particle board or plywood is adhered and fixed on the support board of the vibration-proof support leg, and the finishing lining such as the flooring is conducted on the floor base panel.

Incidentally, in the conventional floor structure, there is a case where the sound shielding is not enough although the finishing lining is conducted on the floor base panel. The rubber mat is laid between the floor base panel and the finishing lining so that a countermeasure of the sound proof is conducted.

Further, in the conventional floor structure, when considering the strength of the floor base panel, because it is necessary to set the interval of the vibration proof support leg to 400 mm–600 mm, which is comparatively narrow, there is a problem that the number of use of the vibration proof support leg is many and the cost is increased, or the work such as the height adjustment of the floor base panel becomes troublesome.

Generally, as a method by which the interval of the vibration proof support leg is increased, it is considered that the strength is increased by increasing the thickness of the floor base panel, however, because the weight of the floor base panel is increased by the amount, a problem that conveying cost is increased, and the conveyance at the time of operation becomes troublesome, or a problem that it is not suited for the application to the floor of the very high building dwelling house, is generated.

SUMMARY OF THE INVENTION

In view of the above-described circumstances, the present invention is attained, and the object of the present invention is to provide a floor structure which is light weight, and by which the floor impulsive sound level can be reduced, and a floor base panel used for the floor structure.

In order to solve the aforesaid object, the invention is characterized by having the following arrangement.

(1) A floor structure comprising:

a support leg; and a first floor base panel supported by the support leg, wherein a first area of the first floor base panel in contact with the support leg is formed solid, and wherein a plurality of hollow cavities are formed in a second area of the first floor base panel not in contact with the support leg.

(2) The floor structure according to (1), wherein the first floor base panel is a hollow base panel in which the plurality of cavities are formed over the whole, the first area is formed solid by filling a part of the plurality of cavities in the first area with a predetermined member.

(3) The floor structure according to (1) or (2), wherein the plurality of cavities extends in the parallel direction to the first floor base panel.

(4) The floor structure according to (1) or (2), wherein the plurality of cavities are arranged in the parallel direction to the first floor base panel.

(5) The floor structure according to any one of (1) to (4) further comprising a second floor base panel placed on the floor base panel including a plurality of cavities extending in the parallel direction to the second floor base panel, wherein the second floor base panel is placed on the first floor base panel in such a manner that the extending direction of the cavities of the second floor base panel is different from the extending direction of the cavity of the first floor base panel.

(6) The floor structure according to any one of (1) to (5), wherein a support member of the support leg in contact with the first floor base panel and the first area of the floor base panel in contact with the support member are different in their density.

(7) The floor structure according to any one of (1) to (5), wherein a support member of the support leg in contact with the floor base panel and the area in contact with the support member of the floor base panel are different in their rigidity.

(8) A floor structure comprising:

a support leg;

a floor base panel supported by the support leg; and a weight arranged on an upper surface of an area of the support member where the support member supports.

(9) A floor structure comprising:

a support leg including a support member;

a floor base panel supported by the support member; and a weight arranged between the support member and the floor base panel.

(10) A floor structure comprising:

a support leg including a support member;

a floor base panel supported by the support member; and a weight attached to the support member.

(11) A floor structure comprising:

a support leg including a support member;

a floor base panel supported by the support member, wherein the support member in contact with the floor base panel and an area in contact with the support member of the floor base panel are different in their density.

(12) A floor structure comprising:

a support leg including a support member; and a floor base panel supported by the support member, wherein the support member in contact with the floor base panel and an area in contact with the support member of the floor base panel are different in their rigidity.

(13) The floor structure according to any one of (1) to (12), wherein the support member in contact with the floor base panel is held in common with a plurality of the support legs.

(14) A floor base panel used for a floor structure comprising:

an area of the floor base panel supported by the support legs, which is formed solid; and an area not in contact with the support member, which includes a plurality of hollow cavities.

DETAILED DESCRIPTION OF PREFERRED EMBODIMENTS

Figure 1:
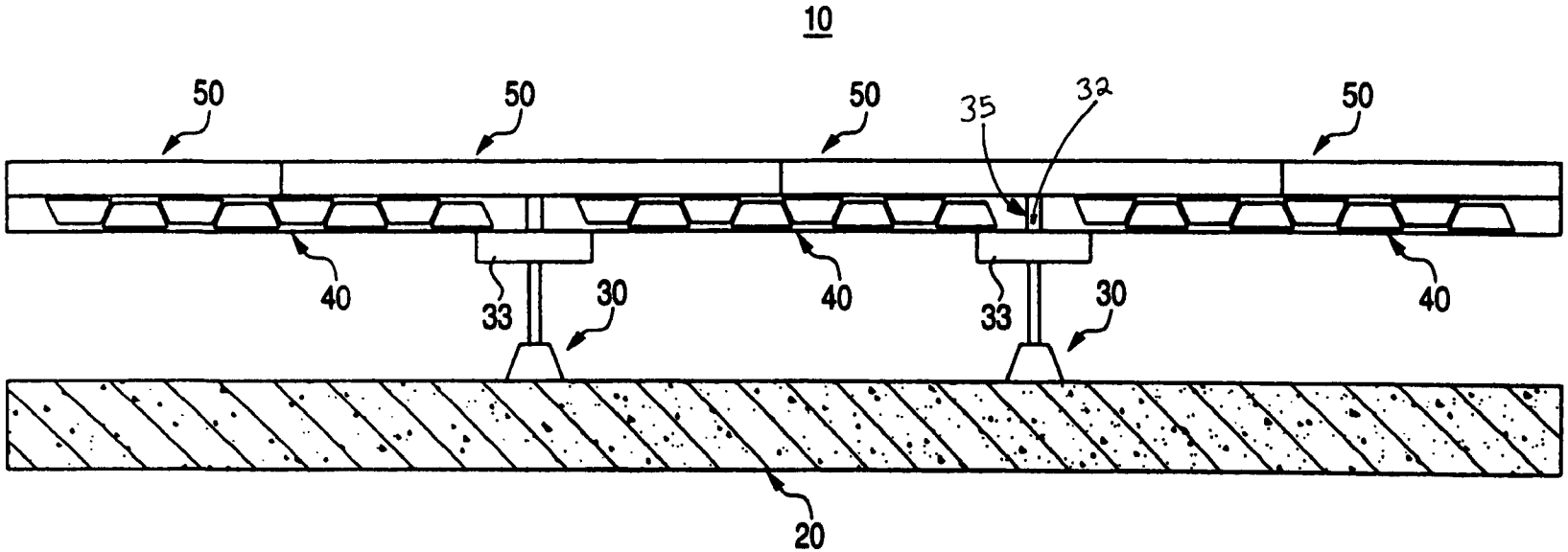
FIG. 1 is a view showing a sound shielding floor of the dry type sound shielding double floor structure according to the first embodiment of the present invention.

Referring to the drawings, the embodiments of the present invention will be detailed below.

(1) The First Embodiment

FIG. 1 is a view showing the sound shield floor of the dry type sound shield double floor according to the first embodiment of the present invention. This sound shield floor 10 includes a vibration proof support leg 30 arranged with a space on a slab 20 which is a body of the building, hollow base panel 40 supported by the vibration proof support leg 30, and finishing material 50 placed on the hollow base panel 40. The vibration proof support leg 30 includes a vertical support bolt 32 which is coupled to a support board 33 to support the floor structure 10. The support bolt 32 extends vertically into the hollow base panel 40 via an aperture 35 in the hollow based panel 40, thereby allowing the hollow base panel 40 to contact the support board 33. The finishing material 50 is flooring material, tatami, and carpet, and an adhesive material may also be arranged between the finishing material 50 and the hollow base panel 40 as needed.

Figure 2:
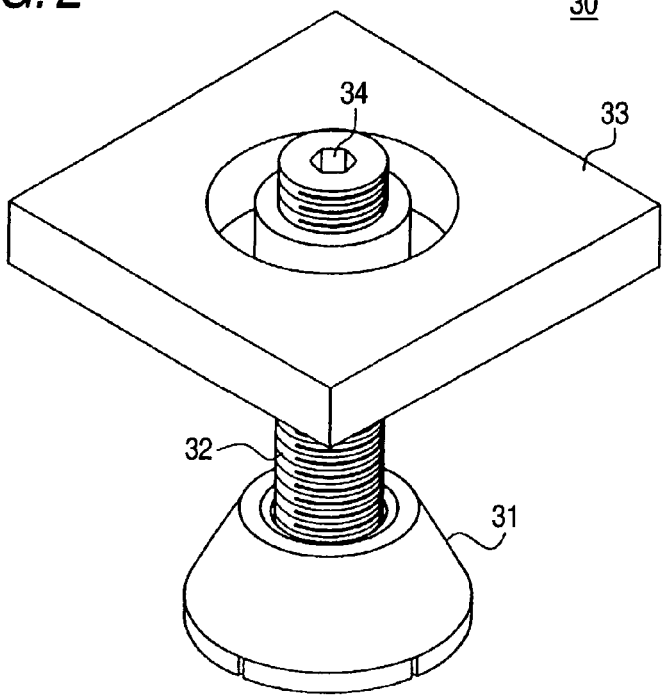
FIG. 2 is a perspective view of a vibration proof support leg.

As shown in FIG. 2, the vibration proof support leg 30 is constituted by a support bolt 32 rotatably supported by a cone frustum vibration proof rubber 31, and a support board 33 screwed on the support bolt 32. On the upper end surface of the support bolt 32, a hexagonal hole 34 is formed, and as shown in FIG. 1, the hollow base panel 40 is structured so as to be placed on the support board 33 with a space so that the hexagonal hole 34 can be viewed from the top. The height of the hollow base panel 40 can be adjusted (leveled) by rotating the support bolt through the hexagonal hole 34 by using by using a hexagonal wrench. Incidentally, the hollow base panel 40 may be adhered and fixed on the support board 33, or it may be fixed on the support board 33 by using a screw or bolt.

The hollow base panel 40 is a wood thin strip laminated plate in which a wood thin strip is laminated, and is the floor base panel structured so that substantially trapezoidal cavities 41 are formed with a predetermined interval in the longitudinal direction (floor surface parallel direction), and the strength and weight reduction can stand together.

Figure 3:
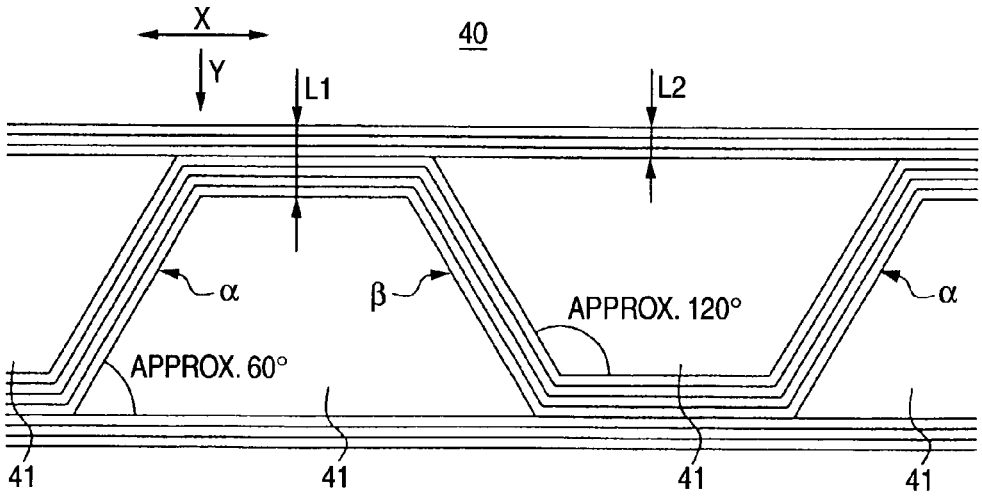
FIG. 3 is a partially enlarged view of a hollow base panel used for the sound shielding floor.

FIG. 3 is a view showing an enlarged view of the side surface of the hollow base panel 40. As shown in this view, the hollow base panel 40 is so structured that the lamination direction of the wood thin strips between the cavities 41 are respectively at the about 60° obliqueness and 120° obliqueness (an area shown by signs $\alpha$, $\beta$). Therefore, in the hollow base panel 40, because the force applied in the perpendicular direction to the floor surface (Y direction), and in the parallel direction to the floor surface (X direction) acts in almost compression direction to the longitudinal direction of the wood thin strip, the strength to the force applied from these directions becomes high.

Because the lamination direction of the wood thin strip between the cavity 41 and the cavity 41 is alternately laminated in the left and right symmetrical inclination angle to the perpendicular direction to the floor surface, the strength against the force applied from any direction of the left and right direction of the parallel direction to the floor surface is maintained uniformly high. Accordingly, although the weight is reduced by providing the hollow structure to the hollow base panel 40, the strength (rigidity) in the perpendicular direction to the floor surface and in the parallel direction to the floor surface can be maintained high. Thereby, because this hollow base panel 40 can increase the strength/weight ratio as compared with the particle board or lamination plate generally used as the floor base panel, even when the strength equal to the conventional floor base panel is provided, the panel weight can be reduced.

The hollow base panel 40 is formed, as shown in FIG. 1, such that, in the area on the support board 33 of the vibration proof support leg 30, the cavity 41 does not exist. In other word, the perpendicular area to the floor surface on the support board 33 of the hollow base panel 40 is formed solid. As described above, by forming the solid portion and the hollow portion in the hollow base panel 40, when the hollow base panel 40 is regarded as the vibration propagation path, because the impedance of the solid portion and that of the hollow portion became discontinuous, the reflection occurs on the boundary of the solid portion and the hollow portion.

Therefore, because the vibration energy propagated from the impact point of the hollow base panel 40 is repeatedly reflected before it is transmitted to the support board 33, when it repeatedly passes the complicated transmission path of the hollow portion, it is attenuated in a short time. Thereby, the vibration energy transmitted from the hollow base panel 40 to the slab 20 through the vibration proof support leg 30, or the sound energy transmitted by the vibration of the hollow base panel 40 to the slab 20, can be reduced, and the sound shielding floor 10 can greatly reduce the floor impact sound level.

As shown in FIG. 3, in this hollow base panel 40, because the discontinuity of the impedance is generated in a portion of the thickness L1 and the thickness L2, the vibration energy transmitted from the impact point in the floor parallel direction is reflected on the boundary portion of the thickness, and attenuated in a short time.

In this sound shielding floor 10, because the hollow base panel 40 with the high weight reduction and surface rigidity is used, when the weight per sheet of the hollow base panel 40 is made equal to the conventional base panel, the panel dimension can be made larger than the conventional one. Accordingly, when the dimension of the length and width of the hollow base panel 40 per one sheet is increased, the arrangement interval of the vibration proof support leg 30 can be increased, and the number of use of the vibration proof support leg 30 can be reduced. When the number of use of the vibration proof support leg 30 can be reduced, because the height adjustment (horizontal leveling) operation of the hollow base panel 40 is simplified, the material cost and the operation cost can be reduced.

In the conventional floor base panel, due to the limitation of the dimension (dimension limitation from the withstand load of the vibration proof support leg 30, the resonance frequency of the floor base panel is near the resonance frequency of the slab 20, and the sound shielding property is reduced. On the other hand, in this hollow base panel 40 according to the embodiment, because not only the dimension of the length or width of the hollow base panel 40, but the degree of freedom of the design work of the thickness dimension is increased, the shape can be easily designed so that the resonance frequency of the base floor panel is separated from the resonance frequency of the slab 20. Thereby, by using the hollow base panel 40, the sound shielding floor 10 having a predetermined rigidity and sound shielding property can be easily designed. In this connection, also by changing the shape or dimension of the cavity of the hollow base panel 40, the resonance frequency of the hollow base panel 40 can be changed.

Next, the production method and the material of the hollow base panel 40 will be specifically described.

Figure 4:
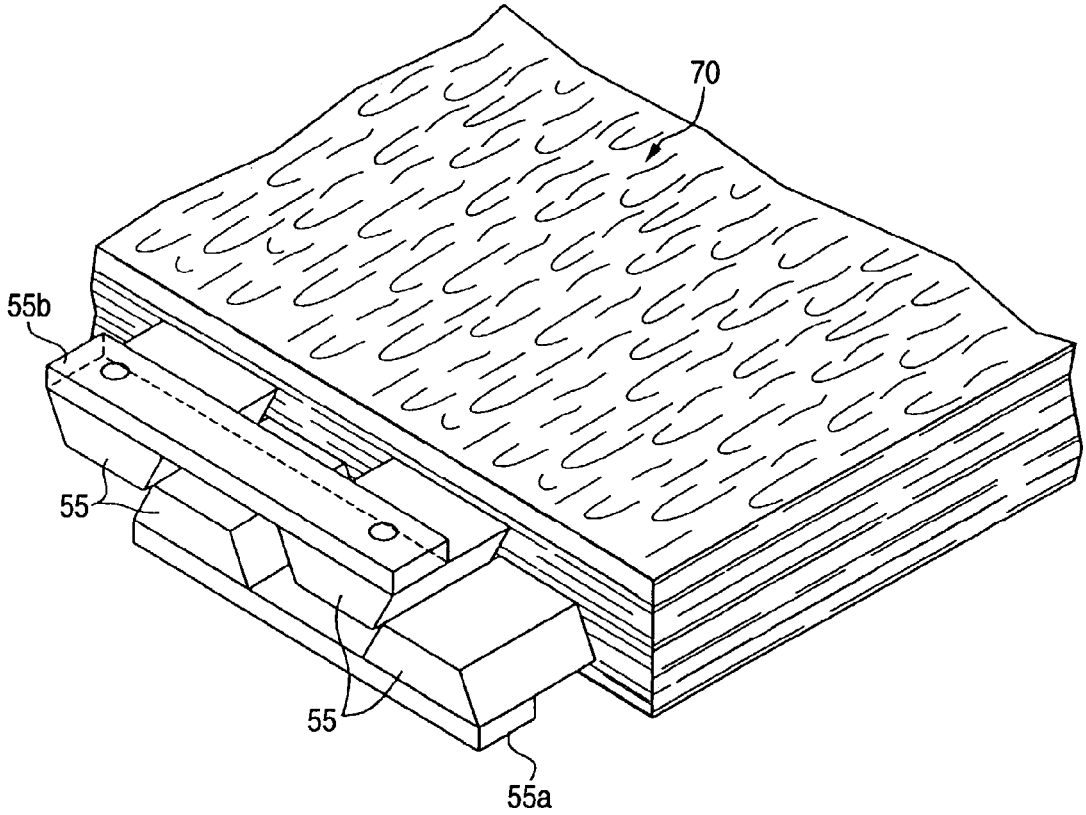
FIG. 4 is a view used for the explanation of a production method of the hollow base panel.

This hollow base panel 40 is produced as follows. As shown in FIG. 4, after the binder is adhered to the wood thin strip, a core 55 constituted by the trapezoidal aluminum bar connected at the equal interval by a connection plate 55*a* is arranged on the first layer–several layers (a plurality of layers) of the wood thin strip, and after the amount of one layer–several layers of the wood thin strip is applied thereon, the core 55 constituted by the trapezoidal aluminum bar connected at the equal interval by a connection plate 55*b* is arranged thereon, and the wood thin strips is further applied. In this case, the core 55 connected by the connection plate 55*a* and the core 55 connected by the connection plate 55*b* are arranged so that the trapezoid is reversed upwardly and downwardly.

Next, the laminated body 70 in which the wood thin strip are laminated, is thermal pressure molded at the temperature 140–220° C., pressure 15–40 kg/cm, for 6–15 minutes, and thermal pressure molded until the thickness is ⅓–1/30, and after the core 55 is pulled out after the cooling, by trimming the outer periphery of the laminated body 70, the hollow base panel 40 can be produced.

As the wood thin strip, normally, an akamatsu (Japanese red pine), karamatsu (Japanese larch), ezomatsu (Saghalin spruce), todomatsu (Soghalin fir), aspen, and lodge pole pine are used, and the kind of wood is particularly not limited. The wood thin strip may be arranged in such a manner that the grain of wood is arranged in almost one direction, or the wood thin strip may be laminated in such a manner that it is made three layer structure, and the direction of grain of wood of the adjoining layers is perpendicular to each other, however, particularly it is not limited. A plurality of kinds of wood thin strips may be mixed, or the mixing rate of the wood thin strip and the binder maybe changed in response to Corresponding to the strength or rigidity of the hollow base panel 40 which is a target.

As the binder, any one of the foaming binder resin, no-forming binder resin, and their mixture, may be used. The foaming binder resin is preferable. Because the foaming binder resin combines the wood thin strips with each other, and the resin itself foams, the amount of use of the resin is reduced by spreading the gap of the wood thin strips by the foaming cell, and the density of the hollow base panel 40 can be reduced. Further, the heat insulation effect or sound shielding effect of the hollow base panel 40 can be increased by the foaming cell.

As the foaming binder resin, either one of the self-foaming foaming resin, or mixing foaming resin in which the foaming agent is added to the non-foaming resin such as phenol, urea, epoxy, or acrylic resin, may be used. In view of the purpose to obtain the increase of the rigidity and the hollow base panel 40 with the low density, it is preferable to use the self-foaming foaming resin. As the self-foaming foaming resin, the foaming polyurethane resin, isocyanate resin, or preferably PMDI (poly-metallic MDI or coarse MDI) can be listed. In this connection, when foaming polyurethane resin or isocyanate resin is used, because it is easily reacted with the water, and the isocyanate group (—NCO) is reacted with the water and self-foamed, the reaction time is advanced, and the time necessary for the thermal pressure molding can be reduced.

It is preferable that an amount of the binder to the wood thin strip is 3.5–20 weight parts to the wood thin strip 100 weight parts (absolute dry weight). By changing the addition amount of the binder, the density and strength of the hollow base panel 40 can also be changed. In this connection, the hardener, curing catalyst, hardening accelerator, diluent, thickener, dispersing agent, or water repellant agent, may be added to the binder as the need arise.

Further, it is preferable that the wood thin strip is previously acetylated. When it is acetylated, it is preferable that, after the wood thin strip is dried to not larger than the water content 3%, preferably, to not larger than 1%, it is preferable that it is made in contact with the vaporized vapor such as acetic acid, acetic anhydride, or chloroacetic acid, and is acetylated (degree of the acetylation 12–20%) in the vapor phase. By acetylating the wood thin strip as described above, the water resistance is obtained, and the aging change of the dimension can be prevented.

(2) The Second Embodiment

Figure 5:
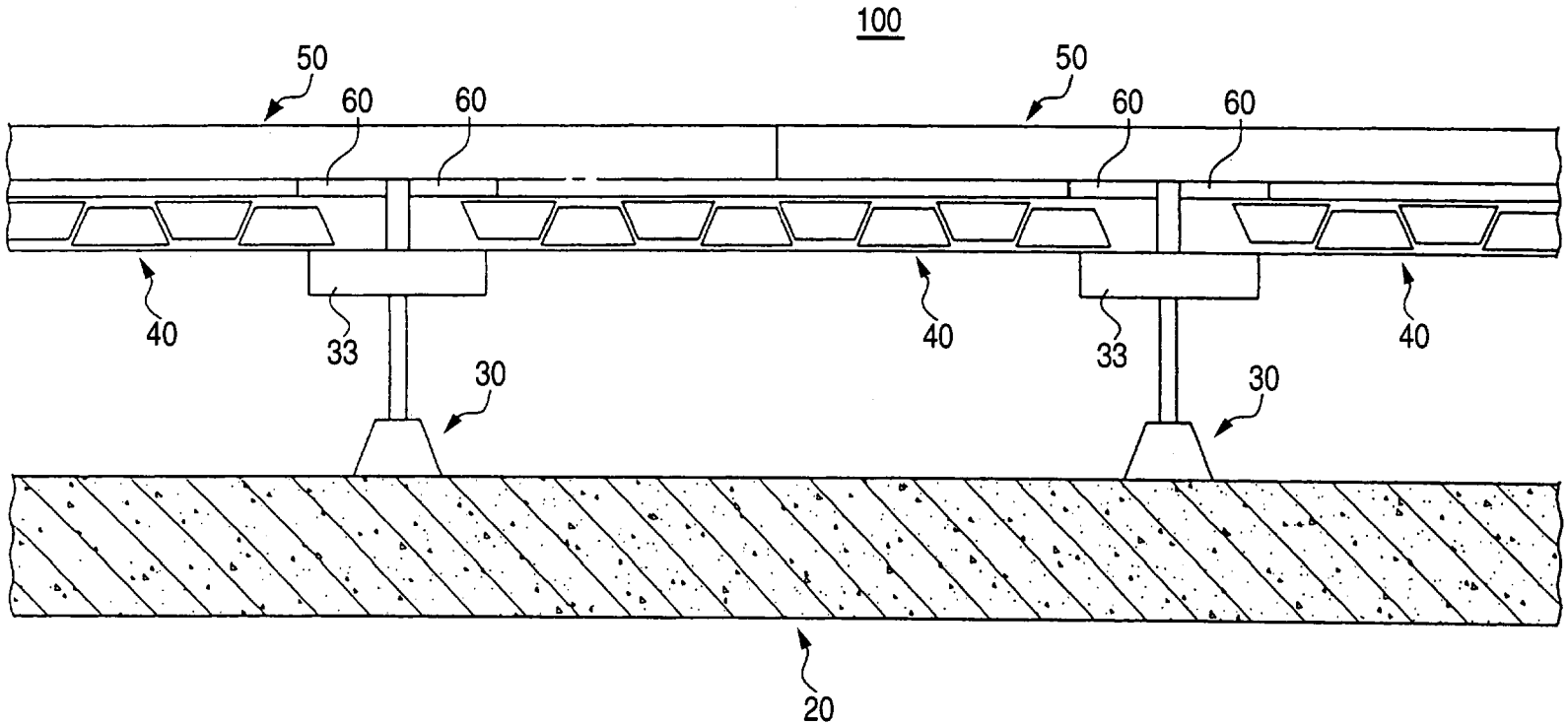
FIG. 5 is a view showing the sound shielding floor of the dry type sound shielding double floor structure according to the second embodiment of the present invention.

FIG. 5 is a view showing a sound shielding floor of a dry type sound shielding double floor according to the second embodiment of the present invention. Because this sound shielding floor 100 is the same as the sound shielding floor 10 according to the first embodiment except a point that a weight 60 is arranged between the hollow base panel 40 and the finish material 50, the same sign is attached to the same portion, and the duplicated explanation is omitted, and only the different portion will be described below.

Figure 6:
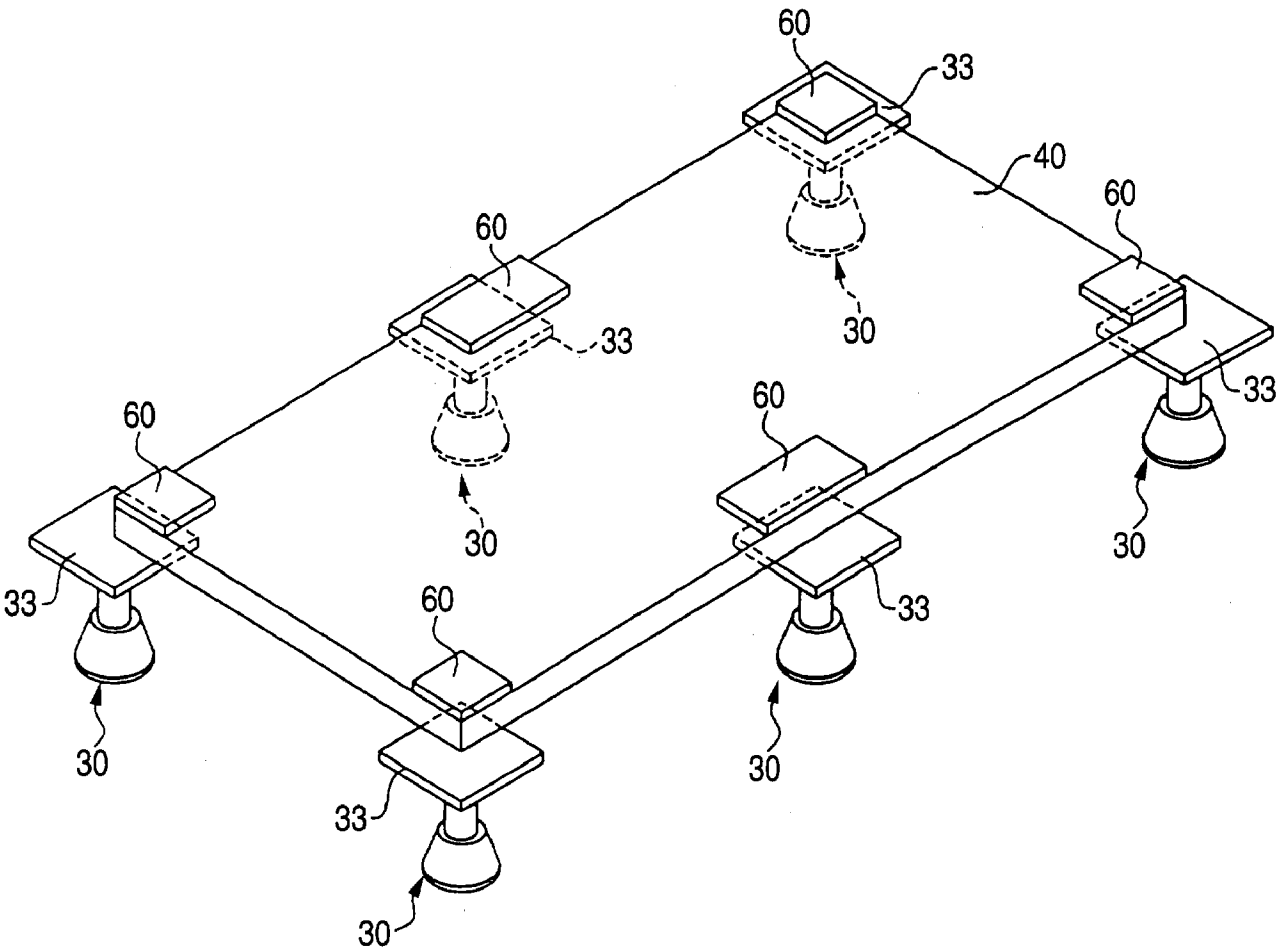
FIG. 6 is a view used for the explanation of the arrangement position of a weight of the hollow base panel.
Figure 7:
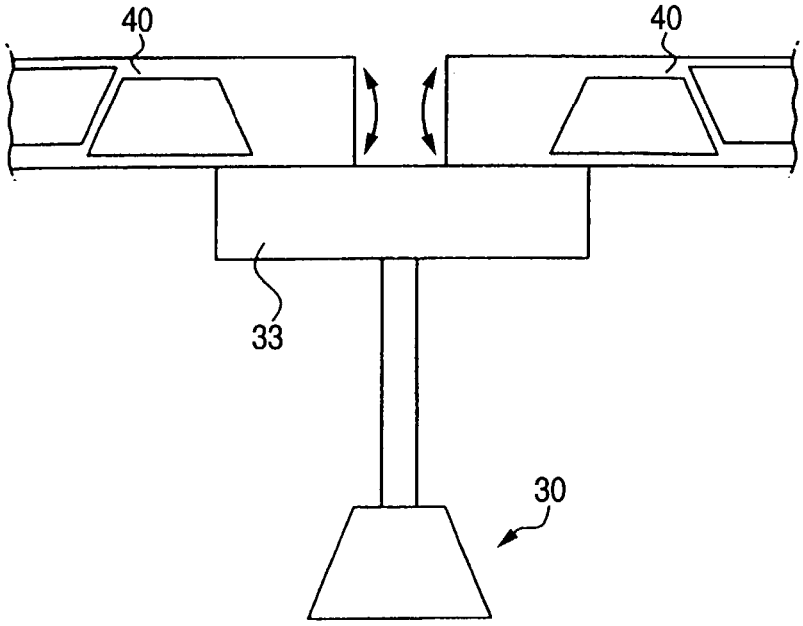
FIG. 7 is a view used for the explanation of an effect of the weight the support leg extending into an aperture of the floor base is not shown for purpose of clarity.
Figure 8:
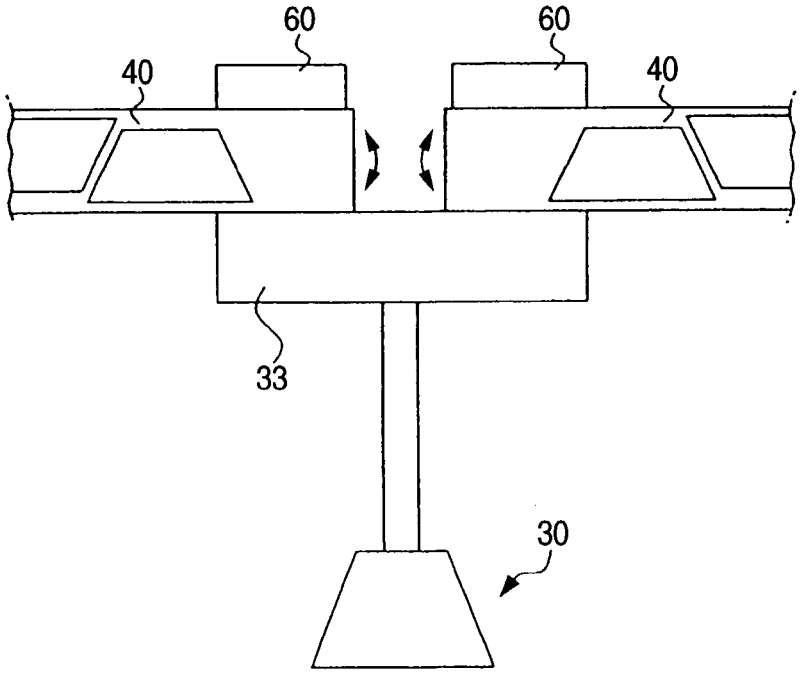
FIG. 8 is a view used for the explanation of an effect of the weight the support leg extending into an aperture of the floor base is not shown for purpose of clarity.

FIG. 6 is a view showing the arrangement position of the weight 60 arranged on the hollow base panel 40. The weight 60 is arranged on the upper surface of the hollow base panel 40 in such a manner that it is arranged on the upper side position of the support board 33 of the 6 sets of vibration proof support legs 30 supporting the hollow base panel 40. That is, although the hollow base panel 40 is vibrated in the arrowed direction as shown in FIG. 7 when the impact is received, the deflection or vibration speed (vibration frequency) at the time of the vibration is reduced by arranging the weight 60 as shown in FIG. 8, and the exciting force of the slab 20 can be reduced.

Figure 9:
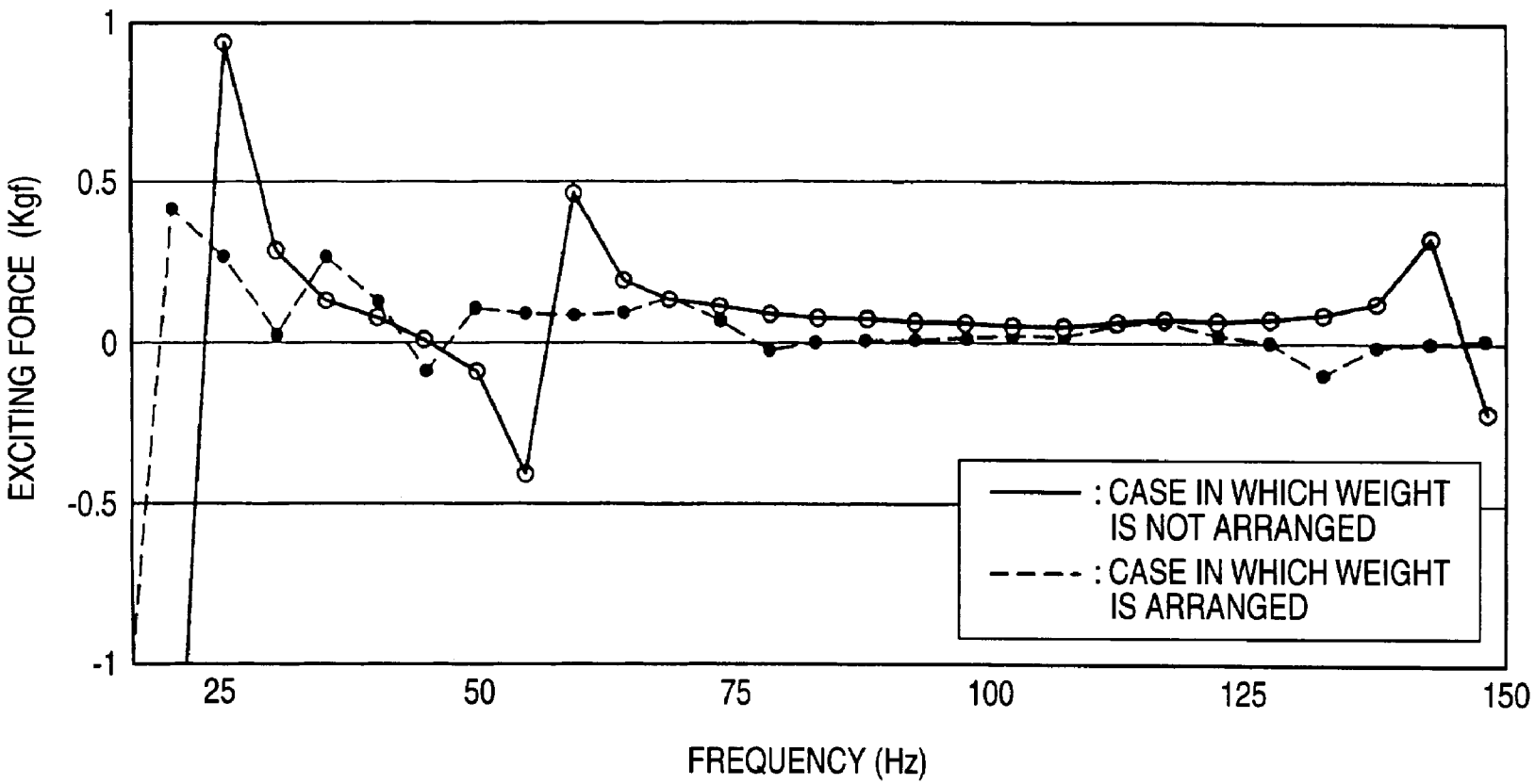
FIG. 9 is a view showing the simulation result when the weight is not arranged and when arranged.

Specifically, in FIG. 9, as the simulation result of a case where the weight 60 is not arranged, and it is arranged, is shown, in the case where the impact is applied on the center of the hollow base panel 40, when the weight 60 is not arranged, the exciting force of the maximum about 1.0 kgf is generated, and particularly, at 57 Hz close to the resonance frequency of the slab 20, the exciting force of about 0.5 kgf is generated largely. In contrast to this, when the weight 60 is arranged, the maximum exciting force is reduced to a half, that is, about 0.5 kgf, and because the exciting force at not smaller than. 40 Hz is reduced to not larger than 0.2 kgf, it can be confirmed that the exciting force at the resonance frequency of the slab 20 is greatly reduced. In this connection, relating to the weight 60, a case where the weights of 2.275 kg are respectively arranged at the 4 corners of the hollow base panel 40, and the weights of 5.454 kg are respectively arranged on the middle of the long side (refer to FIG. 6), is assumed.

Particularly, in the case where the vibration (vibration mode) in which, when one side of the hollow base panel 40 on one support board 33 is deflected upwardly, the other side is deflected downwardly, is generated, when the weight 60 is not arranged, the vibration proof support leg 30 is swung, and the vibration is transmitted to the slab 20, however, by arranging the weight 60, because the vibration of the hollow base panel 40 can be suppressed, the effect that the stability of the vibration proof support leg 30 is increased, and the vibration proof function can be sufficiently functioned, can also be obtained.

Thereby, because the sound shielding floor 100 according to the present invention can greatly reduce the exciting force of the slab 20, in addition to the effect of the first embodiment, the floor impact sound level can be further reduced. Further, in the present embodiment, a case where the weight 60 is formed into a rectangular parallelopiped shape, is shown in a view, however, it is needless to say that it may be an arbitrary shape.

(3) Modified Example

The present invention can be applied to various modes, not limiting to the above-described embodiments. For example, the following modified embodiment can be carried out.

Figure 10:
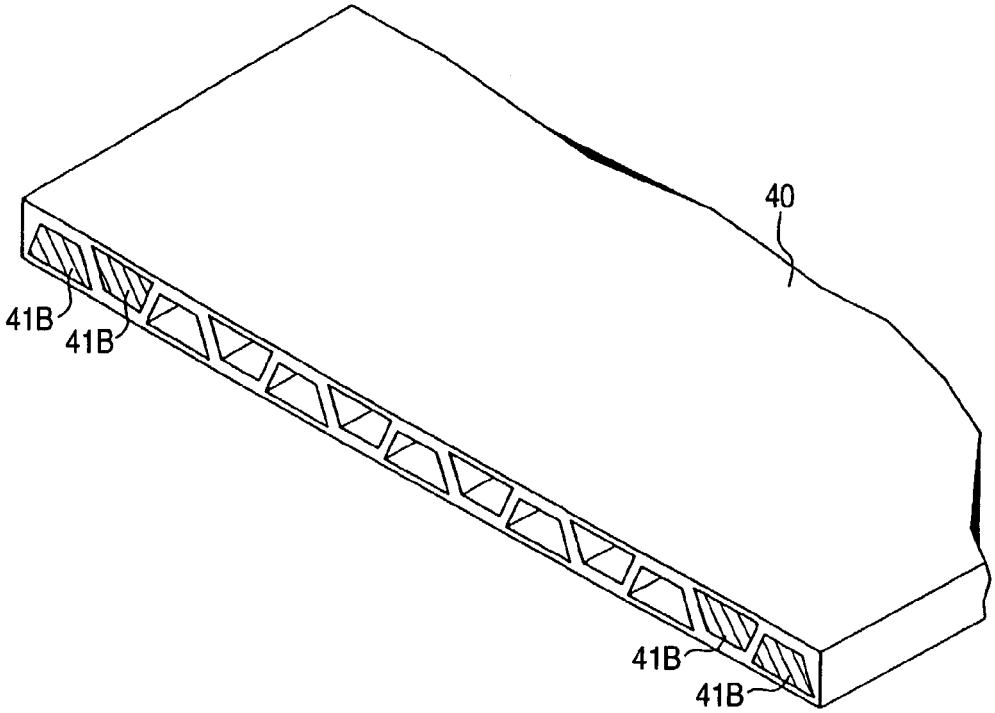
FIG. 10 is a view used for the explanation of a modified example of the hollow base panel.

In the above-described first embodiment, in order to make the area on the support board 33 of the hollow base panel 40 solid, a case where it is previously formed so that the cavity 41 does not exist, is described, however, as shown in FIG. 10, by inserting a member 41B such as the wood, metal, foaming member, or rubber into the cavity 41 in an area on the support board 33 of the hollow base panel 40, it may also be processed to the solid later.

Figure 11:
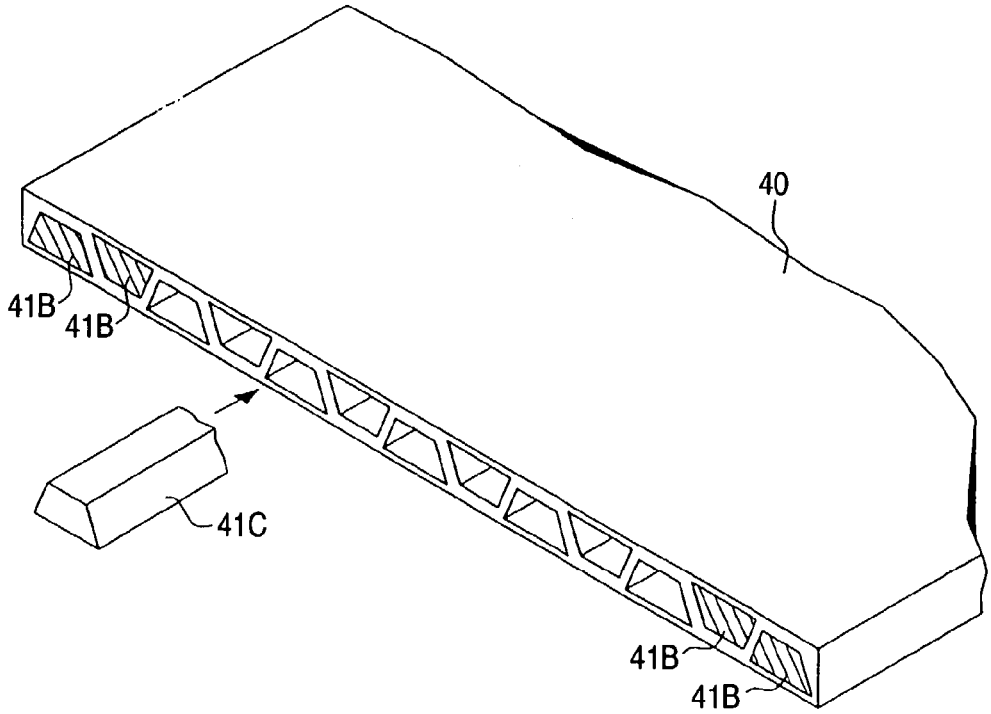
FIG. 11 is a view used for the explanation of the modified example of the hollow base panel.

In this connection, in order that the description may be easily understood, the cavity which is made solid is shown by a slanting line in the view. As shown in FIG. 11, a filling material 41C is inserted into the cavity 41, and the both end area of the cavity 41 may be made solid. In this case, by changing the number in which the filling material 41C is inserted, or the position of the cavity 41, the natural frequency of the hollow base panel 40 can be changed.

Figure 12:
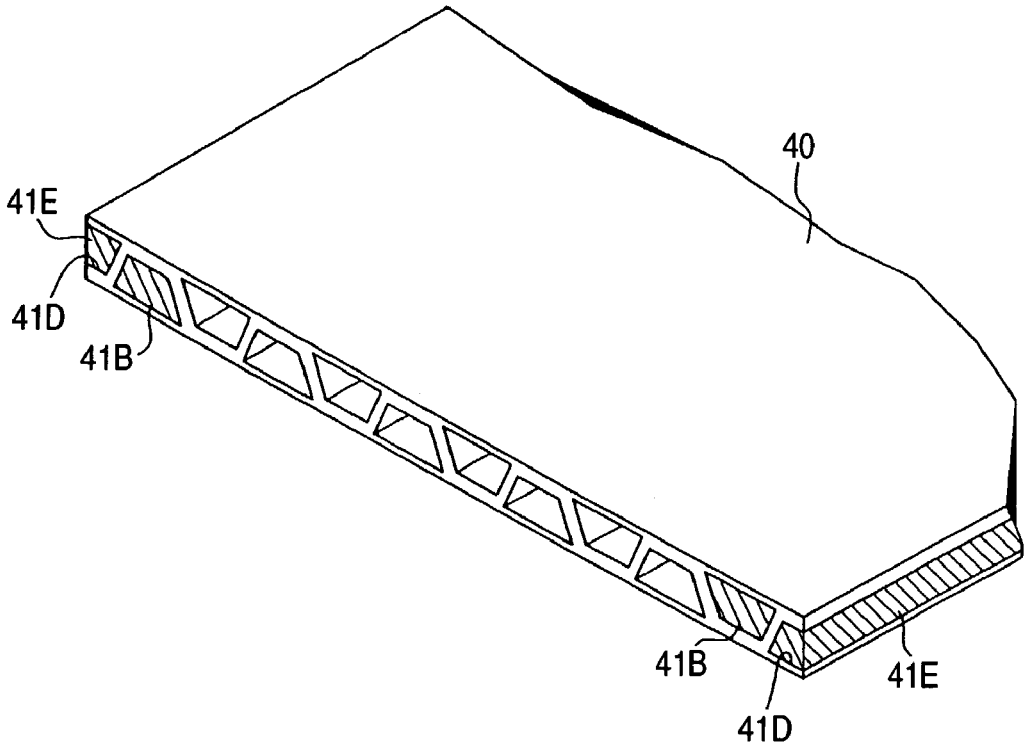
FIG. 12 is a view used for the explanation of the modified example of the hollow base panel.

As shown in FIG. 12, when the end portion of the hollow base panel 40 has the cavity 41D such as a groove or gap formed by cutting the cavity 41 on the midway, and the cavity 41D exists on the support board 33, by filling the cavity 41D by a material 41E such as the wood, metal, foaming member, or rubber, it may be made solid. As described above, by filling the already formed cavities 41 and 41D later, not only a case where the end portion of the regular sized panel is supported, but it can also be applied to a case where the panel which is cut into an arbitrary shape is used. Further, also to the panel in which the whole surface which does not have the solid portion, has the hollow structure, it can be applied in the same manner.

Figure 13:
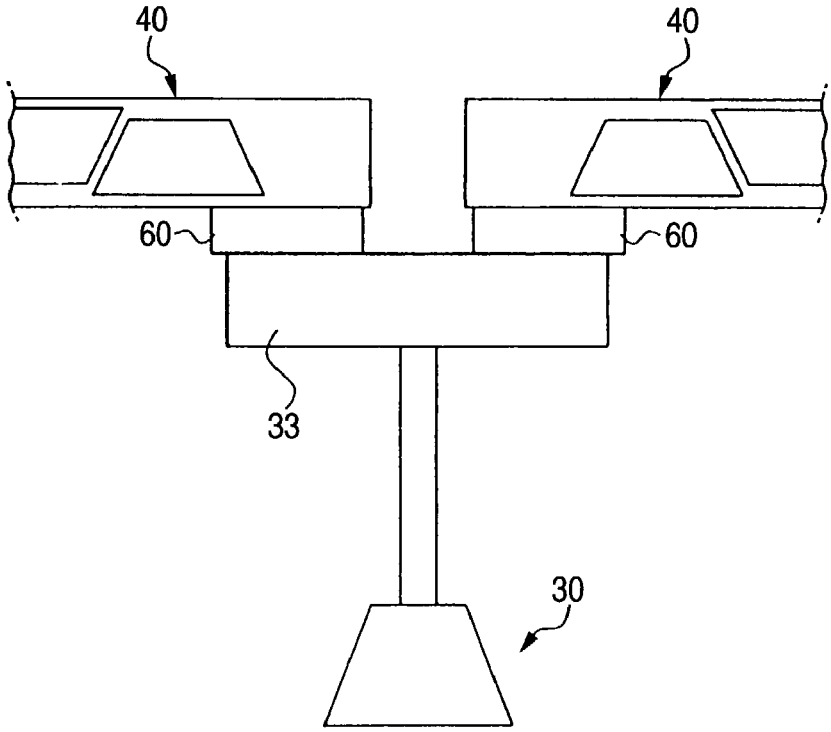
FIG. 13 is a view used for the explanation of a modified example of the arrangement position of the weight.
Figure 14:
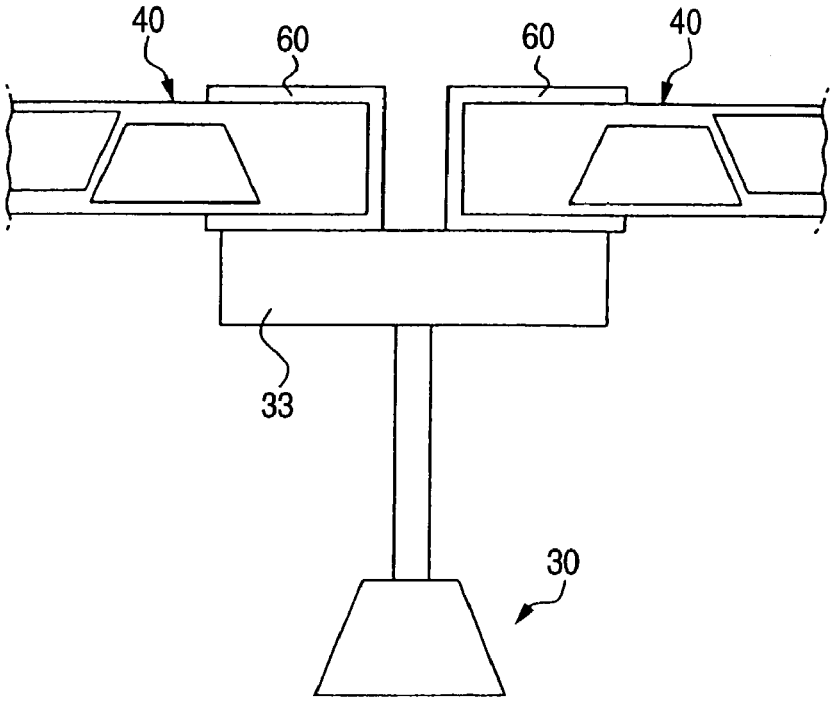
FIG. 14 is a view used for the explanation of the modified example of the arrangement position of the weight.
Figure 15:
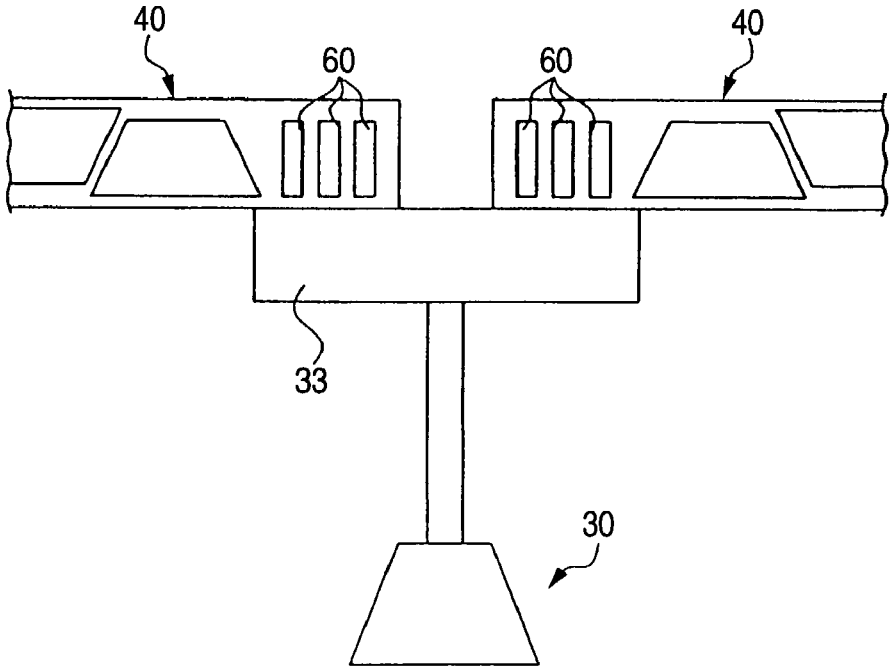
FIG. 15 is a view used for the explanation of the modified example of the arrangement position of the weight.

In the above-described second embodiment, the case where the weight 60 is arranged above the support board 33 of the vibration proof support leg 30 and on the upper surface of the hollow base panel 40, is described (refer to FIG. 6). Alternatively, the vibration on the support board 33 of the hollow base panel 40 is suppressed, or the swing of the vibration proof support leg 30 accompanied by the vibration of the hollow base panel 40 is reduced, and the exciting force of the slab 20 can be reduced by the method in which the weight is arranged between the hollow base panel 40 and the support board 33 as shown in FIG. 13, or by the method in which the end portion of the hollow base panel 40 is covered by the weight 60 as shown in FIG. 14, or by the method in which the weight 60 is inserted in the predetermined area on the support board 33 of the hollow base panel 40 as shown in FIG. 15.

Figure 16:
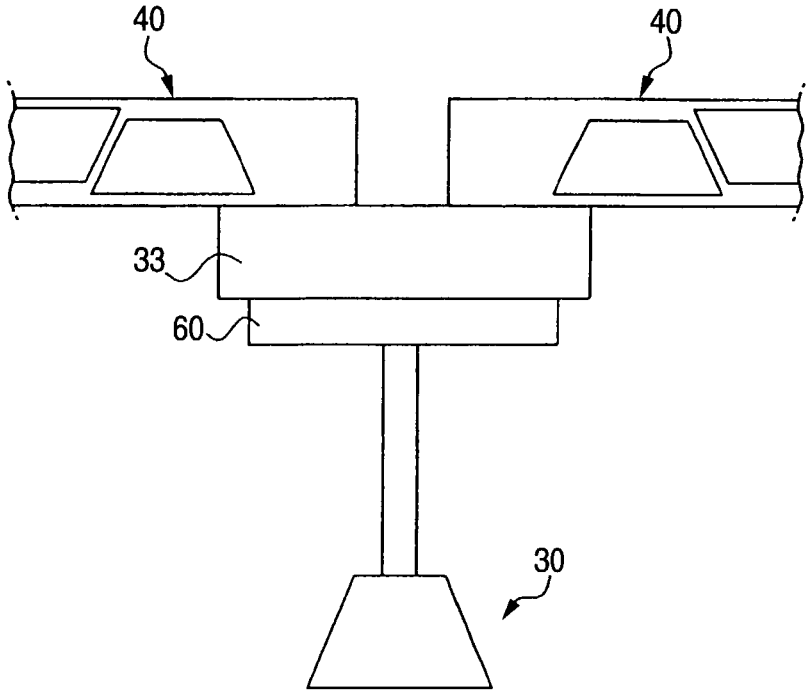
FIG. 16 is a view used for the explanation of the modified example of the arrangement position of the weight.

As shown in FIG. 16, the weight 60 is attached to the support board 33 itself and by increasing the moment of inertia of the vibration proof support leg, a case where the vibration proof support leg 30 is swung by the vibration of the hollow base panel 40 can be avoided. In this connection, in the above-described second embodiment and modified embodiment, the case where the hollow base panel 40 described in the first embodiment is used, is described, however, when the desired floor impact sound level can be obtained by only arranging the weight 60, the conventional floor base panel such as the particle board can be used.

In each embodiment, a plurality of sheets of the hollow base panel 40 may be used by being superimposed. In this manner, the rigidity and sound shielding property of the floor surface can be further increased. In this case, it is preferable that they are superimposed so that the extending direction of the cavity 41 of each hollow base panel 40 is different. When the extending direction of the cavity 41 is made different, it is for the reason in which, because the propagation speed of the vibration to the same direction is different for each hollow base panel 40, by the shift of the vibration of the mutual hollow base panels 40, the vibration energy can be attenuated.

In the above-described each embodiment, the case where the vibration energy transmitted to the support board 33 is reduced by reflecting the vibration energy propagated on the hollow base panel 40 on the boundary between the hollowed portion and the solid portion of the hollow base panel 40, is described. Alternatively, when the difference of the impedance between the area on the support board 33 of the floor base panel such as the hollow base panel 40 and the support board 33 is increased, the vibration energy transmitted to the support board 33 may be reduced. Specifically, it may be made so that the density or rigidity between the area on the support board 33 of the floor base panel and the support board 33, is greatly different, and for example, the above-described hollow base panel 40 may be used as the floor base panel with the high rigidity, or for the support board 33, normal wood material may be used. Further, for example, the material change (the material whose sound impedance is largely different from the wood material, for example, metal, stone, or high density resin), or the shape change may be carried out.

Figure 17:
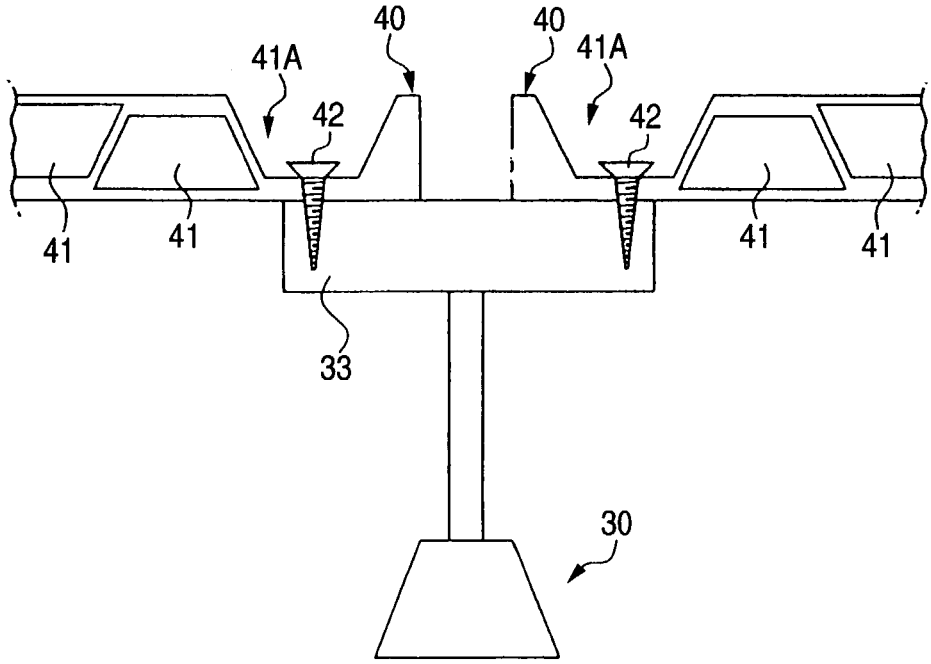
FIG. 17 is a view used for the explanation of a modified example of the fixing method of the hollow base panel.

In the above-described each embodiment, as shown in FIG. 17, the cavity 41A whose upper portion is opened, is formed on the area of the support board 33 of the hollow base panel 40, and in the cavity 41A, when the hollow base panel 40 is fixed to the support board 33 by using a screw (or bolt) 42, the hollow base panel 40 can be easily fixed to the support board 33. In the case where the hollow base panel 40 and the support board 33 are fixed together and is not integrated, when the hollow base panel 40 placed on the support board 33 is vibrated, the member which is moved to upward coexists with the member which is moved to downward, and the torque is added to the vibration proof support leg 30. However, in the case where the hollow base panel 40 is fixed and integrated as described above, when it is vibrated, the phase of a plurality of the hollow base panels 40 placed on the support board 33 coincides with each other, and the rotation exerted on the vibration proof support leg 30 is suppressed, and the exciting force to the floor slab is reduced.

Figure 18:
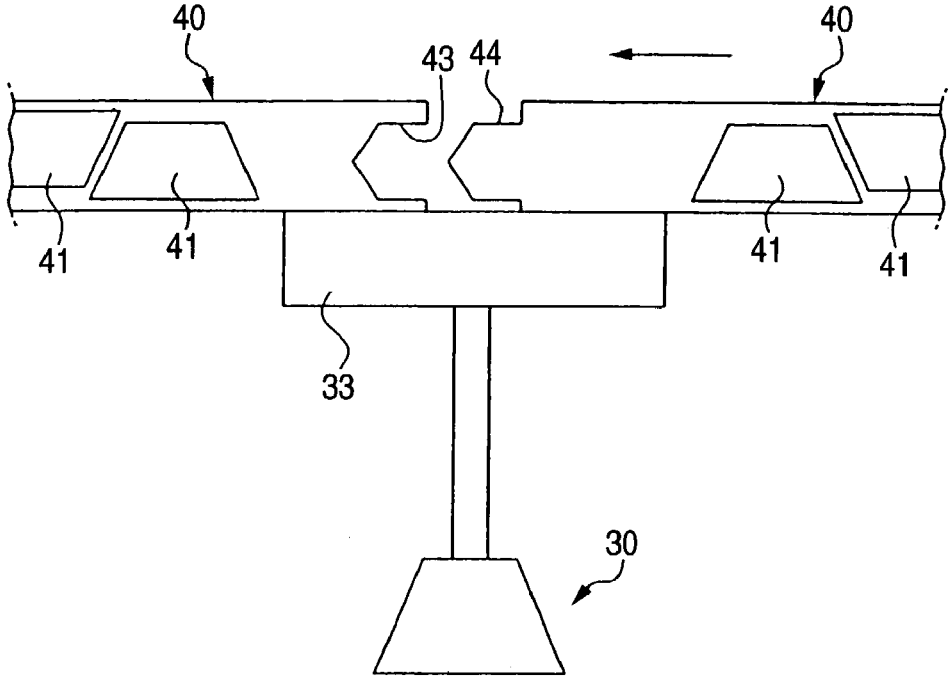
FIG. 18 is a view used for the explanation of the modified example of the fixing method of the hollow base panel.
Figure 19:
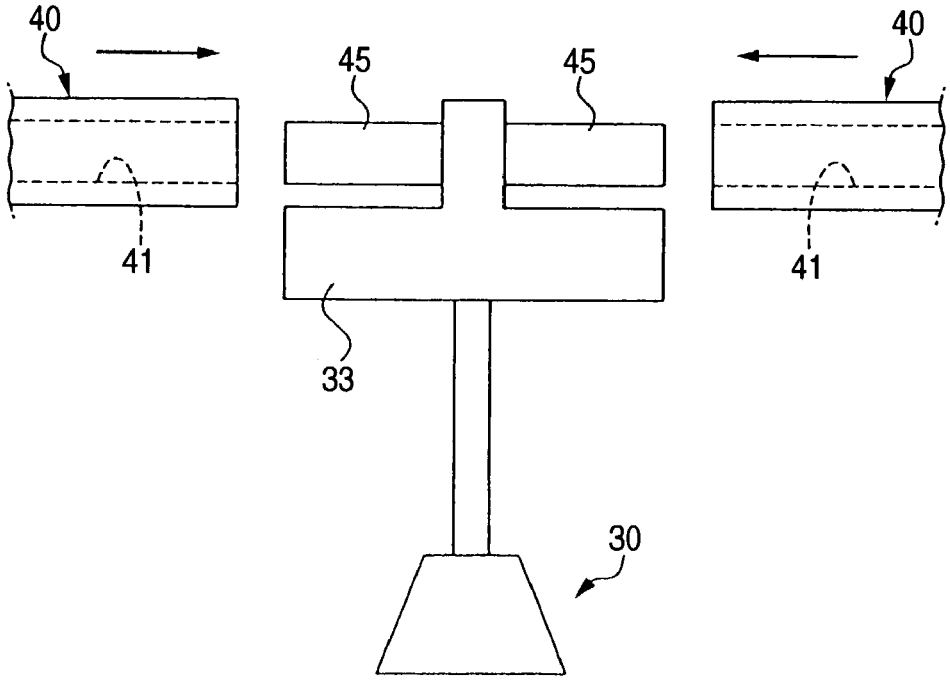
FIG. 19 is a view used for the explanation of the modified example of the fixing method of the hollow base panel.
Figure 20A:
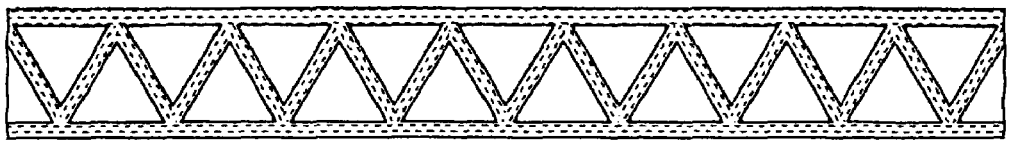
FIGS. 20A to 20D are views used for the explanation of modified examples of the hollow base panel.
Figure 20B:
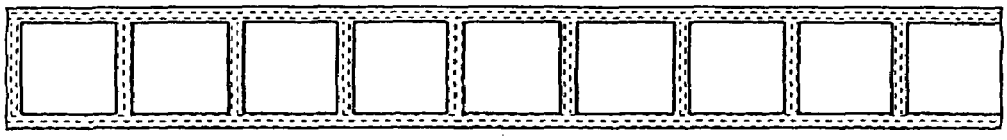
Figure 20C:
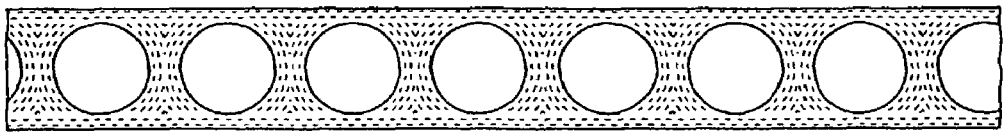
Figure 20D:
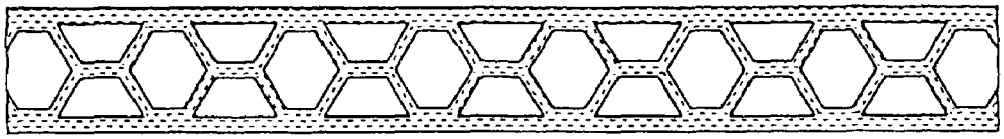

As shown in FIG. 18, it may be structured in such a manner that, a concave portion 43 and a convex portion 44 engaged with the concave portion 43 are provided on the side surfaces of the hollow base panels 40, respectively. The hollow base panels 40 are easily and accurately combined, and can be fixed together. In this connection, it is needless to say that the technology shown in FIG. 17 and FIG. 18, may be applied to the floor base panel other than the hollow base panel 40. Further, as shown in FIG. 19, it may also be structured in such a manner that, an engagement portion 45 to engage with the cavity 41 of the hollow base panel 40 is provided on the support board 33 of the vibration proof support leg 30. The hollow base panel 40 and the vibration proof support leg 30 are easily and securely combined, and can be fixed together.

Further, in the above-described each embodiment, the case where the hollow base panel in which almost trapezoidal cavity 41 is formed, is used, is described. However, as shown in FIGS. 20A to 20D, various shapes such as a polygonal shape such as triangle shape (shown in FIG. 20A), or quadrangle shape (shown in FIG. 20B), or circular shape such as true circle (shown in FIG. 20C) or ellipse, may be applied to the cavity 41, or a plurality of the cavities 41 may be provided in the upward direction and downward direction (shown in FIG. 20D). The case where the hollow base panel 40 is made of only the wood thin strip, is described. However, the upper surface or lower surface of the hollow base panel 40 may be structured by a decorative board, or may also be produced by various materials such as the plastic or metallic material.

Figure 21:
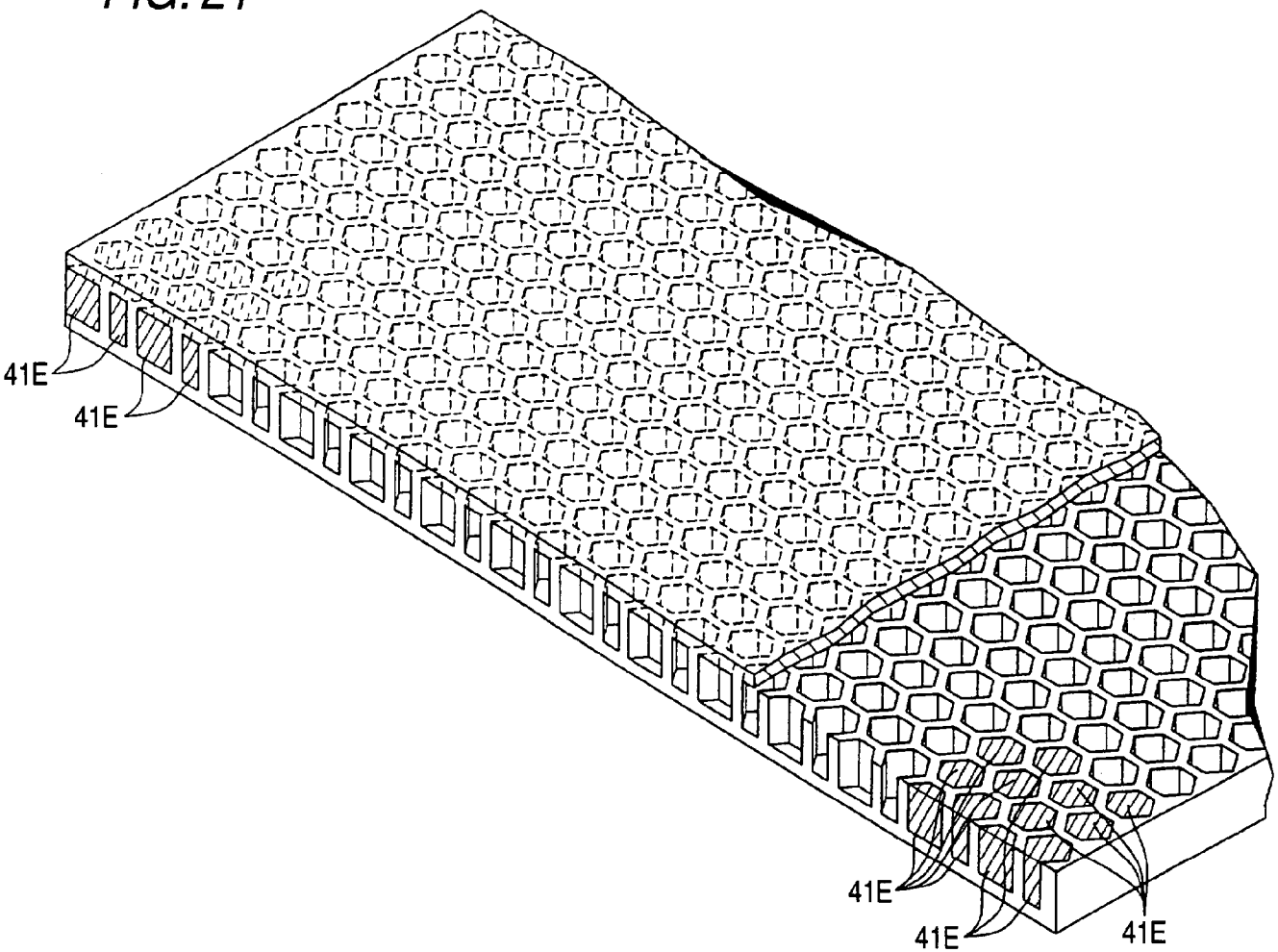
FIG. 21 is a view used for the explanation of the modified example of the hollow base panel.

In the above-described each embodiment, the case where the present invention is applied to the hollow base panel in which the inside cavity 41 is extended in the parallel direction to the floor surface, is described. However, it is of course that the present invention can widely be applied to the various hollow base panels such as the hollow base panel of the honeycomb construction as shown in FIG. 21. In this connection, in FIG. 21, a case where an area in contact with the support board 33 is filled by the above-described member 41E is shown, however, it is of course that previously the area may be made solid structure.

Figure 22:
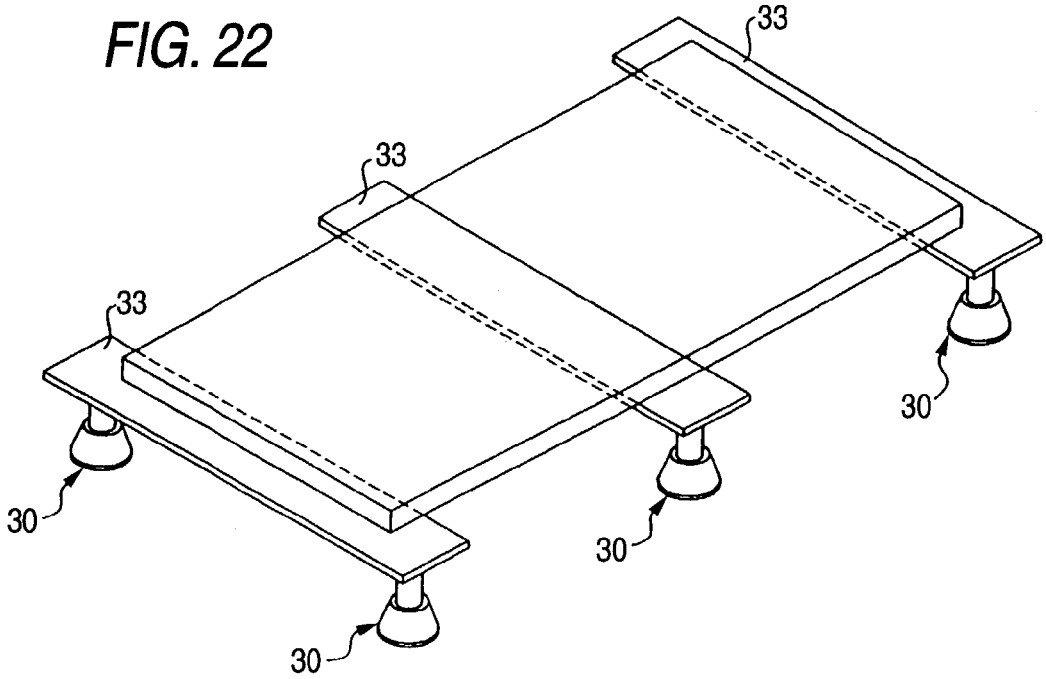
FIGS. 22 and 23 are views used for the explanation of the modified examples of a support leg.
Figure 23:
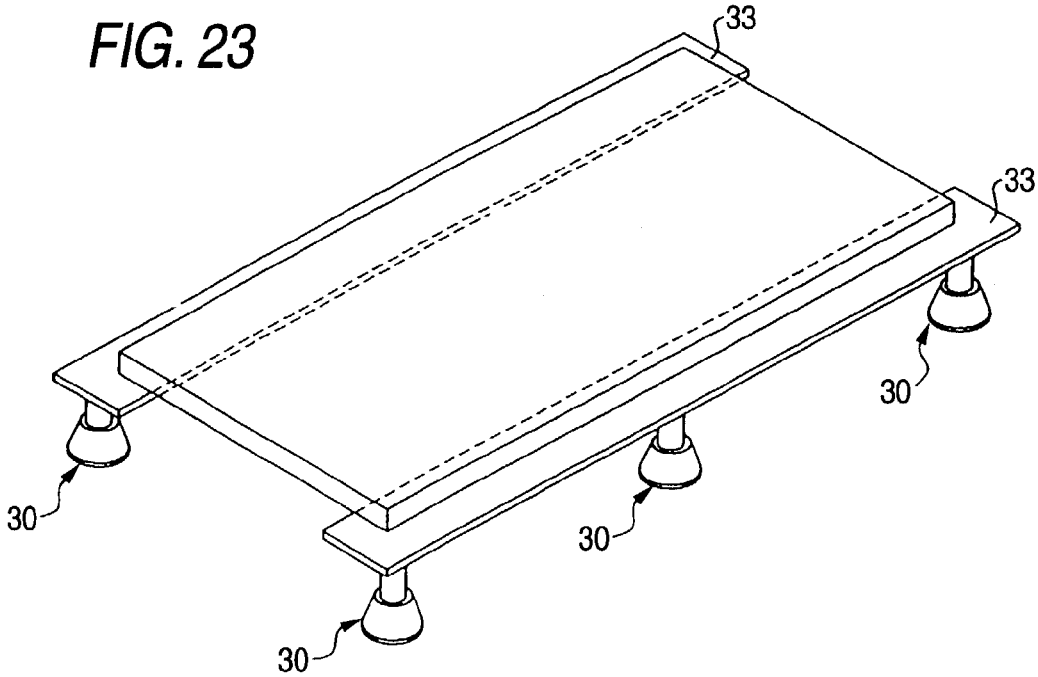

In the above-described each embodiment, as shown in FIG. 22, the support board 33 may be structured such that it is commonly used with a plurality of vibration proof support legs 30. In this manner, not only the number of parts of the vibration proof support leg 30 can be reduced, but the stability or rigidity of the floor can be increased by an amount in which the contact area of the support board 33 with floor base panel is increased.

According to the present invention as described above, even when the cavity is provided in the floor base panel and the panel weight is reduced, the vibration energy transmitted from the floor base panel to the support leg can be reduced, and the floor impact sound level can be reduced.

What is claimed is:

1. A floor structure comprising:

a support leg; and a first floor base panel supported by the support leg, the first floor base panel is a separate structure from the support leg having a first area in contact with the support leg that formed solid, a plurality of hollow cavities are formed in a second area of the first floor base panel not in contact with the support leg, and the support leg extending vertically into an aperture in the first area of the first floor base panel.

2. The floor structure according to claim 1, wherein the plurality of cavities extend parallel to the first floor base panel.

3. The floor structure according to claim 1, wherein the plurality of cavities are arranged parallel to the first floor base panel.

4. The floor structure according to claim 1, wherein a support member of the support leg in contact with the first floor base panel and the first area of the floor base panel in contact with the support member are different in their density.

5. The floor structure according to claim 4, wherein the support member in contact with the floor base panel is held in common with a plurality of the support legs.

6. The floor structure according to claim 1, wherein a support member of the support leg in contact with the floor base panel and the first area in contact with the support member of the floor base panel are different in their rigidity.

7. The floor structure according to claim 6, wherein the support member in contact with the floor base panel is held in common with a plurality of the support legs.

8. A floor structure comprising:

a support leg; and a first floor base panel supported by the support leg, wherein a first area of the first floor base panel in contact with the support leg is formed solid, a plurality of hollow cavities are formed in a second area of the first floor base panel not in contact with the support leg, the first floor base panel is a hollow base panel in which the plurality of hollow cavities are formed throughout, and the first area is formed solid by filling a part of the plurality of cavities in the first area with a predetermined member.

9. The floor structure according to claim 8, wherein the plurality of cavities extend parallel to the first floor base panel.

10. The floor structure according to claim 8, wherein the plurality of cavities are arranged in parallel to the first floor base panel.

11. The floor structure according to claim 8 further including a second floor base panel placed on the floor base panel including a plurality of cavities extending parallel to the second floor base panel, and wherein the second floor base panel is placed on the first floor base panel in such a manner that the extending direction of the cavities of the second floor base panel is different from the extending direction of the cavity of the first floor base panel.

12. The floor structure according to claim 8, wherein a support member of the support leg in contact with the first floor base panel and the first area of the floor base panel in contact with the support member are different in their density.

13. The floor structure according to claim 12, wherein the support member in contact with the floor base panel is held in common with a plurality of the support legs.

14. The floor structure according to claim 8, wherein a support member of the support leg in contact with the floor base panel and the first area in contact with the support member of the floor base panel are different in their rigidity.

15. The floor structure according to claim 14, wherein the support member in contact with the floor base panel is held in common with a plurality of the support legs.

16. A floor structure comprising:

a support leg;

a first floor base panel supported by the support leg, wherein the first floor base panel is a separate structure from the support leg and a first area of the first floor base panel in contact with the support leg is formed solid, and a plurality of hollow cavities are formed in a second area of the first floor base panel not in contact with the support leg and the plurality of cavities parallel to the first floor base panel; and a second floor base panel placed on the floor base panel including a plurality of cavities extending parallel to the second floor base panel, wherein the second floor base panel is placed on the first floor base panel in such a manner that the extending direction of the cavities of the second floor base panel is different from the extending direction of the cavity of the first floor base panel.

17. A floor structure comprising:

a support leg;

a first floor base panel supported by the support leg, wherein the first floor base panel is a separate structure from the support leg and a first area of the first floor base panel in contact with the support leg is formed solid, and a plurality of hollow cavities are formed in a second area of the first floor base panel not in contact with the support leg; and a second floor base panel placed on the first floor base panel including a plurality of cavities extending parallel to the second floor base panel, wherein the second floor base panel is placed on the first floor base panel in such a manner that the extending direction of the cavities of the second floor base panel is different from the extending direction of the cavities of the first floor base panel.

18. A floor structure comprising:

a support leg;

a first floor base panel supported by the support leg, wherein the first floor base panel is a separate structure from the support leg and a first area of the first floor base panel in contact with the support leg is formed solid, and a plurality of hollow cavities are formed in a second area of the first floor base panel not in contact with the support leg; and a second floor base panel placed on the first floor base panel including a plurality of cavities extending in the parallel direction to the second floor base panel, wherein the second floor base panel is placed on the first floor base panel in such a manner that the extending direction of the cavities of the second floor base panel is different from the extending direction of the cavities of the first floor base panel.

19. A floor structure comprising:

a support leg including a support member;

a floor base panel supported by the support leg; and a weight arranged on an upper surface of an area of the support member where the support member supports.

20. The floor structure according to claim 19, wherein the support member in contact with the floor base panel is held in common with a plurality of the support legs.

21. A floor structure comprising:

a support leg including a support member;

a floor base panel supported by the support member; and a weight arranged between the support member and the floor base panel.

22. The floor structure according to claim 21, wherein the support member in contact with the floor base panel is held in common with a plurality of the support legs.

23. A floor structure comprising:

a support leg including a support member;

a floor base panel supported by the support member; and a weight attached to the support member.

24. The floor structure according to claim 23, wherein the support member in contact with the floor base panel is held in common with a plurality of the support legs.

25. A floor structure comprising:

a support leg including a support member; and a floor base panel supported by the support member of the support leg, wherein the support leg is a separate structure from the floor base panel, the support member of the support leg in contact with the floor base panel, an area of the floor base panel in contact with the support member of the support leg and an area of the floor base panel not in contact with the support member are all different in their density, and the support leg extends vertically into an aperture in the first floor base panel.

26. The floor structure according to claim 25, wherein the support member in contact with the floor base panel is held in common with a plurality of the support legs.

27. A floor structure comprising:

a support leg including a support member; and a floor base panel supported by the support member of the support leg, wherein the support leg is a separate structure from the floor base panel, the support member of the support leg in contact with the floor base panel, an area of the floor base panel in contact with the support member of the support leg and an area of the floor base panel not in contact with the support member are all different in their rigidity, and the support leg extends vertically into an aperture in the first floor base panel.

28. The floor structure according to claim 27, wherein the support member in contact with the floor base panel is held in common with a plurality of the support legs.

29. A floor base panel used for a floor structure comprising:

a first area of the floor base panel which is formed solid and supported by a plurality of support legs, wherein the floor base panel is a separate structure from the support leg and each of the plurality of support legs extends vertically into a corresponding aperture in the floor base panel; and a second area of the floor base panel, not in contact with the plurality of support legs, which includes a plurality of hollow cavities.

* * * * *